United States Patent [19]

Worley

[11] 4,161,805

[45] Jul. 24, 1979

[54] PROCESS AND APPARATUS FOR CARDING FIBERS

[75] Inventor: Nathan T. Worley, Seneca, S.C.

[73] Assignee: Phillips Petroleum Company, Bartlesville, Okla.

[21] Appl. No.: 878,098

[22] Filed: Feb. 15, 1978

[51] Int. Cl.[2] ..... D01G 15/02

[52] U.S. Cl. ..... 19/98; 19/107; 19/101

[58] Field of Search ..... 19/107, 98–101

[56] References Cited

U.S. PATENT DOCUMENTS

| | | | |
|---|---|---|---|
| 2,241,151 | 5/1941 | Miller | 19/98 X |
| 3,438,093 | 4/1969 | Rutz | 19/107 |

FOREIGN PATENT DOCUMENTS

| | | | |
|---|---|---|---|
| 838138 | 6/1960 | United Kingdom | 19/107 |

*Primary Examiner*—Dorsey Newton

[57] ABSTRACT

Fibers are carded to produce a web on a carding machine on which at least one gaseous barrier is produced near at least one end of the main cylinder roll of the carding machine so that the edge of the web of fibers on the main cylinder roll is maintained a distance from the end of the main cylinder roll.

21 Claims, 5 Drawing Figures

PROCESS AND APPARATUS FOR CARDING FIBERS

BACKGROUND OF THE INVENTION

The invention relates to a method and apparatus suitable for carding fibers.

The use of a carding machine to produce uniform webs of staple fibers, including natural fibers and synthetic fibers, by brushing the fibers and positioning the fibers more or less parallel to one another is well known in the art. When carding natural fibers such as cotton or wool, the carding process is also used to remove impurities from the fibers. While the carding process is a highly developed art, a number of problems still exist.

One of the main problems in any carding operation is the buildup of fibers on the journals of the various rolls. In addition to the main cylinder roll of a carding machine, there are worker and stripper rolls which, in conjunction with the main cylinder roll, brush and parallelize the fibers; a feed roll which feeds the fibers to the main cylinder roll; and a doffing roll which removes the combed and parallelized fibers from the main cylinder roll. Each of these rolls has a journaled axle and the buildup of fibers on and around the journals causes them to wear prematurely which in turn causes an increase in maintenance and costs of operation. While this is a serious problem when carding any type of fibers, processing polypropylene staple exacerbates the problem because of the tendency of this fiber to fuse on the journals and on the ends of the worker and stripper rolls. The fused polypropylene fibers form small hard particles which damage the wire or card cloth, and get into the carded web, resulting in a lower grade product.

An object of the present invention is to reduce the fiber buildup on the journals of a carding machine.

Another object of the invention is the elimination of small hard particles when carding polypropylene staple.

Still another object of the invention is an apparatus suitable for carrying out the above objects.

SUMMARY OF THE INVENTION

According to the invention staple fibers are carded to produce web on a carding machine having a main cylinder roll with a cylindrical surface by forming at least one gaseous barrier near at least one end of the main cylinder roll by directing pressurized gas primarily toward the cylindrical surface adjacent said end at a pressure sufficient to maintain the edge of the web positioned adjacent the end of the main cylinder roll a distance from the end of the main cylinder roll.

Further according to the invention a carding machine comprises a main cylinder roll having a first end and a second end, and means for forming at least one gaseous barrier near at least said first end to maintain the position of an edge of a web of staple fibers carded on said carding machine a distance from the first end of the main cylinder roll. Practice of the present invention substantially reduces the buildup of fibers on the journals of the rolls and, when processing polypropylene staple, effectively eliminates the presence of hard particles of fused polypropylene staple in the carded web.

DETAILED DESCRIPTION OF THE INVENTION

Figure 1:
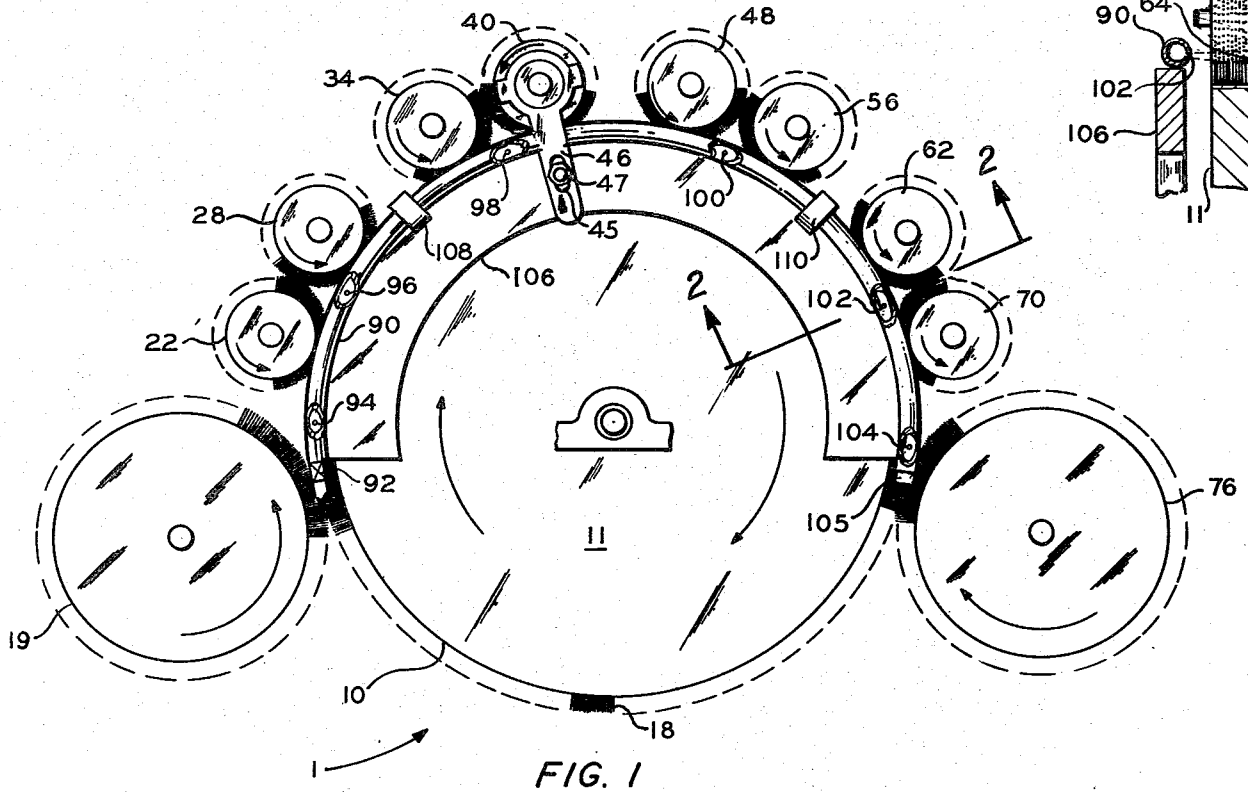
FIG. 1 is a side view of a carding machine illustrating one embodiment of the invention with the frame and the means for driving the various rolls removed so as to more clearly illustrate the invention.

The apparatus of the invention is more easily understood by referring to the drawing and in particular FIG. 1 wherein general reference numeral 1 indicates a carding machine having a main cylinder roll 10, a feed roll 19, worker rolls 22, 34, 48 and 62 and their corresponding stripper rolls 28, 40, 56, and 70, respectively, and doffing roll 76. Each of the rolls are covered with card cloth as shown as reference numeral 18 on main cylinder roll 10. Card cloth comprises a hard tough fabric material through which a large number of wires are attached thereto extending in one direction and approximately the same distance from the fabric, as well known in the art. Main cylinder roll 10 and the associated rolls previously described all have axles rotatably mounted in suitable bearings which are illustrated only for main cylinder roll 10 and stripper roll 40. As known in the art, the various rolls, such as stripper roll 40, are supported on adjustable supports, such as adjustable support 46 which can be adjusted by loosening bolt 47 secured to plate 106 and adjusting support 46 with slot 45.

According to the invention a carding machine is equipped with a means for forming at least one gaseous barrier near at least one end of the main cylinder roll to maintain the position of the edge of a web of staple fibers adjacent the end of the main cylinder roll a distance from the end of the main cylinder roll. The fact that a gaseous barrier is suitable for maintaining the edge of the web of fibers on the main cylinder roll of a carding machine a distance from the edge of the main cylinder roll is surprising because of the way fibers are grasped by the card cloth. It was quite unexpected that a gas could be directed primarily toward the cylindrical surface of the main cylinder roll near an end thereof and maintain the edge of the web on the main cylinder roll a distance from the end of the main cylinder roll without blowing the staple fibers completely off the roll and filling the surrounding air with staple fibers. It has been found that a gaseous barrier can be effectively used to control the edge of a web of staple fibers on the main cylinder roll and thereby accomplish the previously stated objects of the invention.

Figure 3:
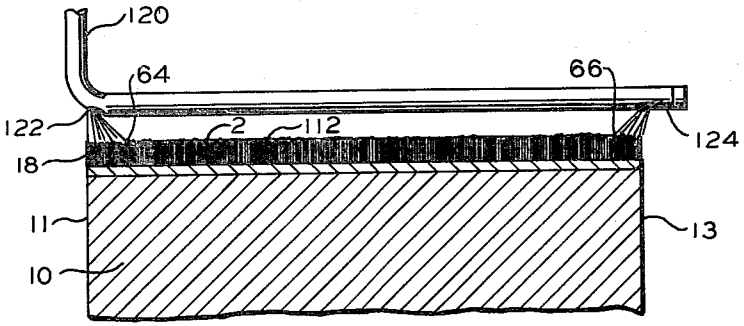
FIG. 3 is a cross-sectional view of another embodiment of the invention showing only the main cylinder roll of the carding machine shown in FIG. 1.

According to the embodiment of the invention illustrated in FIG. 3 means for forming at least one gaseous barrier comprises at least one conduit 120 having at least one orifice 122. Orifice 122 is positioned near end 11 of main cylinder roll 10 and is directed primarily at cylindrical surface 2 of main cylinder roll 10 near end 11. Orifice 124 which is suitable for forming a gaseous barrier near end 13 is positioned near end 13 of main cylinder roll 10 and directed primarily at cylindrical surface 2 of main cylinder roll 10 near end 13. As shown in FIG. 3 it is preferred that the orifices be positioned so that they form an acute angle with the horizontal and are directed downward generally toward the center of cylindrical surface 2 of main cylinder roll 10; however, the orifices can be positioned vertically over cylindrical surface 2 if desired but generally the fibers are not contained on main cylinder 10 as well.

Figure 2:
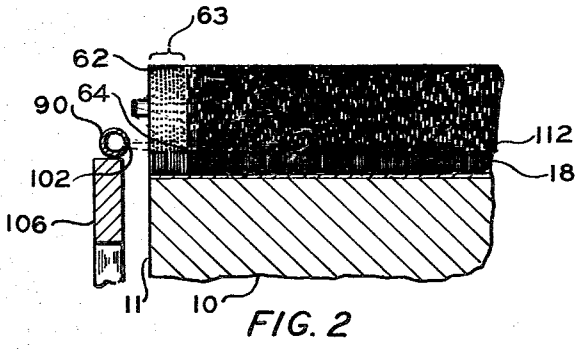
FIG. 2 is a cross-sectional view of the embodiment of FIG. 1 through lines 2—2.

A preferred embodiment of the invention is illustrated in FIG. 1 wherein two conduits are employed, one conduit, conduit 90, is positioned near end 11 of main cylinder roll 10 and the other conduit (not shown) is positioned near the other end of main cylinder roll 10. Conduit 90 comprises a valve 92 and orifices 94, 96, 98, 100, 102 and 104. Orifice 102, shown in FIG. 2, is illustrative of the positions of the orifices in conduit 90 with respect to main cylinder roll 10. Each of the orifices in conduit 90 is positioned to operate in essentially the same manner as orifice 122 shown in FIG. 3, that is, so that it is positioned near end 11 of main cylinder roll 10 and is directed primarily at cylindrical surface 2 near end 11 of main cylinder roll 10. The second conduit referred to above is correspondingly positioned on the opposite side of main cylinder roll 10 with orifices positioned with respect to main cylinder roll 10 corresponding to those described in conduit 90. As shown in FIG. 1, orifice 94 is positioned near feed roll 19, orifice 96 is positioned adjacent the space between worker roll 22 and its corresponding stripper roll 28, orifice 98 is positioned adjacent the space between worker roll 34 and its corresponding stripper roll 40, orifice 100 is positioned adjacent the space between worker roll 48 and its stripper roll 56, orifice 102 is positioned adjacent the space between worker roll 62 and its stripper roll 70, and orifice 104 is positioned near doffing roll 76. Suitable clamps, such as clamps 108 and 110 are employed to attach conduit 90 to a suitable support such as plate 106.

Figure 5:
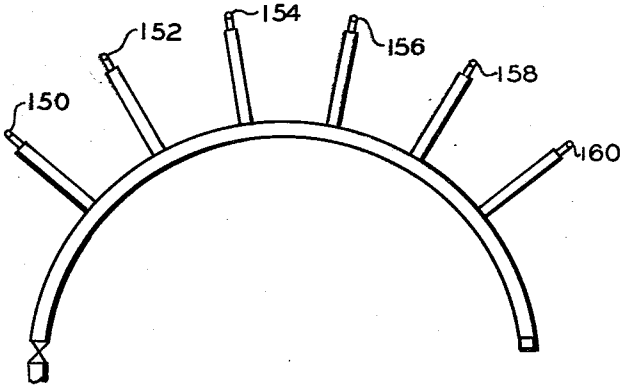
FIG. 5 is a side view of a conduit, schematically illustrated, of another embodiment of the invention suitable for use on the carding machine shown in FIG. 1.
Figure 4:
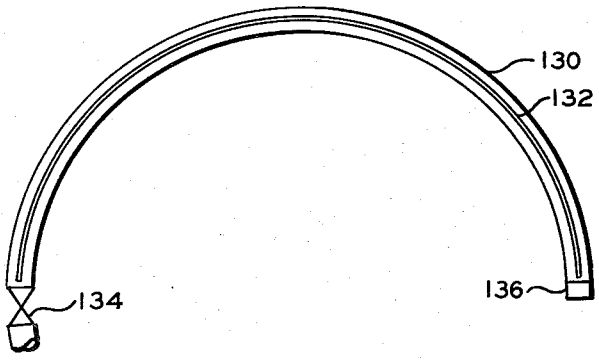
FIG. 4 is a side view of a conduit of another embodiment of the invention suitable for use on the carding machine shown in FIG. 1.

Also as shown in FIG. 1, conduit 90 is positioned adjacent and partially along the circumference of end 11 of main cylinder roll 10. While the conduit and orifice configuration illustrated in FIG. 1 is preferred because it has been successfully employed, any number of variations can be used such as, for example, that illustrated in FIG. 4 wherein a single orifice is employed as slit 132 in conduit 130, conduit 130 having valve 134 and cap 136 similar to valve 92 and cap 105 of conduit 90. As shown in FIG. 1, uniform orifice spacing is not required. Other variations of the embodiment shown in FIG. 1 can be visualized such as the use of a separate conduit for each orifice as shown schematically in FIG. 5 so that each orifice 150, 152, 154, 156, 158 and 160 positioned adjacent the circumference of one end of the main cylinder of a carding machine (not shown) can be adjusted independently of the other orifices, which clearly is within the scope of the invention.

In the process of the present invention, again referring to FIG. 1, main cylinder roll 10 rotates in the manner illustrated by the arrows and picks up staple fibers from feed roll 19. The staple fibers on main cylinder roll 10 are picked up by worker roll 22 rotating in the direction illustrated by the arrow and stripper roll 28 strips the fibers from worker roll 22 rotating in the manner illustrated by the arrow. The action of main cylinder roll 10, worker roll 22 and stripper roll 28 brushes and parallelizes the staple fibers which are deposited onto main cylinder roll 10 in the form of a web of fibers 112 as shown in FIGS. 2 and 3. Each set of worker and stripper rolls functions in a like manner. Then doffing roll 76, rotating in the direction illustrated by the arrow, removes the fibers from main cylinder roll 10 and deposits them on a conveyor or other apparatus (not shown).

In accordance with the embodiment of the process of the invention shown in FIG. 1 at least one gaseous barrier is formed at each end of the main cylinder roll 10 by directing pressurized gas through orifices 94, 96, 98, 100, 102 and 104 in conduit 90 shown in FIG. 1 and through a plurality of orifices in a corresponding conduit (not shown) positioned on the opposite side of main cylinder roll 10. The pressurized gas exiting the orifices strikes cylindrical surface 2 near the ends of main cylinder roll 10 wherein the pressurized gas is employed at a pressure sufficient to maintain edge 64 of web 112 of the staple fibers (more clearly shown in FIGS. 2 and 3) on the main cylinder and at a distance from the end 11 of main cylinder roll 10 and to maintain edge 66 of web 112 (as shown in FIG. 3) a distance from edge 13 of main cylinder roll 10. As shown in FIG. 2 the web 112 of staple fibers in the nip between worker roll 62 and main cylinder 10 is positioned so that edge 64 of web 112 maintains the desired distance 63 from end 11 of main cylinder roll 10. While the distance from end 11 and end 13 of main cylinder roll 10 to the position of the edges 64 and 66 of web 112 respectively on main cylinder roll 10 (as shown in FIG. 3) can be adjusted within a wide range, this distance is generally within a range of from about ½" (1.27 centimeters) to about 2" (5.08 centimeters) although is common to maintain this distance within range of ¾" (1.90 centimeters) to about 1¼" (3.17 centimeters).

While almost any gas can be employed in the practice of the present invention, air is generally employed for obvious reasons; however, the use of any suitable gas other than air is also considered to be within the scope of the present invention.

The pressure of the gas employed is dependent upon a number of parameters such as orifice size, the number of orifices in the conduit, the denier, type and length of the staple being carded, the distance of each orifice from the main cylinder roll, etc. For any given system the pressure is easily determined by simply adjusting a valve such as valve 92 until the staple fibers maintain their desired position on the main cylinder roll. It is of course obvious that too high a pressure would cause at least some of the staple fibers to be blown off the main cylinder roll but this can easily be avoided by reducing the pressure or enlarging the orifice size, or both. An example of a system in accordance with the present invention which has been used with excellent results is provided in the following example.

EXAMPLE

On a 2'-6" (0.76 meter) carding machine 8'-0" wide (2.43 meters) ⅜" (0.952 cm) tubing was bent in the form of an arc of a circle corresponding to approximately half of the circumference of the main cylinder roll. Two pieces of tubing were used, one for each side of the carding machine. In each piece of tubing a valve was installed at one end of the tubing and the other end was closed off with a cap. Six (6) orifices 0.625" (0.158 cm) in diameter were drilled in each piece of tubing approximately in the positions illustrated in conduit 90 of FIG. 1. Straps were used to secure the tubing to a plate adjacent the main cylinder roll. The center line of each piece of tubing was positioned approximately 0.75" (1.90 centimeters) above the cylindrical surface of the main cylinder roll and approximately 0.250" (0.635 cm) from the closest point of the end of the main cylinder roll. The orifices were slightly angled downward toward the center of the cylindrical surface of the main cylinder roll so that the gas passing through the orifices would strike the cylindrical surface of the main cylinder roll near the edge. Air was supplied to both pieces of tubing at a pressure of 15 to 20 psig (1.05 to 1.4 Kgs/sq. cm) at a total flow rate of about 1 cu. ft./min. (4.72 cu. cm/sec.). Polypropylene fibers, 3 denier per filament and 2½" long, were carded on the carding machine and the edges of the web of staple fibers were maintained a distance of approximately 1" from their respective end of the main cylinder roll. A much lower quantity of fibers was found on the journals of the machine and this system essentially eliminated the presence of fused polypropylene particles in the web.

What is claimed is:

1. A method comprising:

carding staple fibers on a carding machine comprising a main cylinder roll having a cylindrical surface and a first end and a second end wherein said staple fibers form a web on the main cylinder roll, said web having a first edge positioned adjacent the first end and a second edge positioned adjacent the second end, and forming at least one gaseous barrier near at least said first end by directing a pressurized gas primarily toward said cylindrical surface adjacent said first end at a pressure sufficient to maintain the first edge of the web a distance from the first end of the main cylinder roll.

2. A method in accordance with claim 1 wherein a plurality of gaseous barriers are employed near each end of the main cylinder roll.

3. A method in accordance with claim 1 wherein the gas is air.

4. A method in accordance with claim 1 wherein at least a portion of the fibers are natural fibers.

5. A method in accordance with claim 1 wherein at least a portion of the fibers are synthetic fibers.

6. A method in accordance with claim 1 wherein the fibers are a mixture of at least two synthetic fibers.

7. A method in accordance with claim 1 wherein at least some of the fibers are polypropylene fibers.

8. A method in accordance with claim 1 wherein the first and second edges of the web are maintained a distance within a range of about ½" (1.27 cm) to about 2" (5.08 cm) from each respective end of the main cylinder roll.

9. A method in accordance with claim 8 wherein the first and second edges of the web are maintained a distance within a range of about ¾" (1.90 cm) to about 1¼" (3.17 cm) from each respective end of the main cylinder roll.

10. A method in accordance with claim 2 wherein about 1.0 cu. ft./min. of air at a pressure within a range of about 15 to about 20 psig (1.054 to 1.406 Kgs/sq. cm) is passed through a total of 12 orifices 0.0625" (0.158 cm) in diameter to provide the gaseous barriers.

11. Apparatus comprising:

a carding machine comprising a main cylinder roll having a first end and a second end and having a cylindrical surface, said carding machine being suitable for forming a web of staple fibers on said main cylinder roll having a first edge positioned adjacent said first end and a second edge positioned adjacent said second end; and means for forming at least one gaseous barrier near at least the first end by directing a pressurized gas toward said cylindrical surface to maintain the position of the first edge of the web a distance from the first end of the main cylinder roll.

12. Apparatus comprising:

a carding machine comprising a main cylinder roll having a cylindrical surface and a first end and a second end, at least one conduit means having at least one orifice therein, positioning means for positioning said at least one conduit means such that said at least one orifice is positioned near said first end and directed primarily at the cylindrical surface near said first end, and a source of pressurized gas attached to said at least one conduit means.

13. Apparatus in accordance with claim 12 wherein said at least one conduit means has at least two orifices therein, said positioning means positions said at least one conduit such that at least one of said orifices is positioned near said first end and directed primarily at the cylindrical surface near said first end and at least one of said orifices is positioned near said second end and directed primarily at the cylindrical surface near said second end.

14. Apparatus in accordance with claim 13 wherein said at least one conduit means comprises a first conduit positioned adjacent and partially along the circumference of the first end of said main cylinder roll and having at least one of said orifices therein and a second conduit positioned adjacent and partially along the circumference of the second end of said main cylinder roll and having at least one of said orifices therein.

15. Apparatus in accordance with claim 14 wherein the carding machine further comprises at least one worker roll and at least one corresponding stripper roll wherein the at least one orifice near said first end is positioned in said first conduit and adjacent the space between said at least one worker roll and said at least one corresponding stripper roll and wherein the at least one orifice near said second end is positioned in said second conduit and adjacent the space between said at least one worker roll and said at least one corresponding stripper roll.

16. Apparatus in accordance with claim 14 wherein said carding machine further comprises a feed roll, a doffing roll and a plurality of worker rolls each having a corresponding stripper roll, wherein said first conduit has a plurality of orifices with at least one orifice positioned near each of said feed rolls, said doffing rolls and adjacent the space between said worker rolls and said corresponding stripper rolls and wherein said second conduit has a plurality of orifices with at least one orifice positioned near each of said feed rolls, said doffing rolls and adjacent the space between said worker rolls and said corresponding stripper rolls.

17. Apparatus in accordance with claim 14 wherein the at least one orifice in said first conduit is a slit extending at least partially along the length of the first conduit and wherein the at least one orifice in said second conduit is a slit extending at least partially along the length of the second conduit.

18. Apparatus in accordance with claim 16 wherein said carding machine comprises one feed roll, one doffing roll and four worker rolls each having a corresponding stripper roll.

19. Apparatus in accordance with claim 18 wherein said first conduit and said second conduit are ⅜" (0.952 cm) tubing each having a center line 0.75" (1.90 cm) above the cylindrical surface of the main cylinder and approximately 0.250" (0.635 cm) from the closest point of the end of the main cylinder roll.

20. Apparatus in accordance with claim 13 wherein said at least one conduit comprises a first conduit having attached thereto a first plurality of conduits each having at least one orifice therein positioned adjacent the circumference of the first end of the main cylinder roll and a second conduit having attached thereto a second plurality of conduits each having at least one orifice therein positioned adjacent the circumference of the second end of the main cylinder roll.

21. Apparatus in accordance with claim 20 wherein each orifice in said first plurality of conduits and said second plurality of conduits is independent.

* * * * *